US011757199B2

(12) United States Patent
Nguyen et al.

(10) Patent No.: US 11,757,199 B2
(45) Date of Patent: Sep. 12, 2023

(54) REFLECTIVE INTELLIGENT REFLECTING SURFACE FLEXIBLE BOARD

(71) Applicant: RESEARCH & BUSINESS FOUNDATION SUNGKYUNKWAN UNIVERSITY, Suwon-si (KR)

(72) Inventors: Minh Tran Nguyen, Seoul (KR); Muhammad Miftahul Amri, Seoul (KR); Kae Won Choi, Seoul (KR); Dong In Kim, Seoul (KR); Ju Young Choi, Seoul (KR); Je Hyeon Park, Seoul (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 0 days.

(21) Appl. No.: 17/825,333

(22) Filed: May 26, 2022

(65) Prior Publication Data

US 2022/0384960 A1 Dec. 1, 2022

(30) Foreign Application Priority Data

May 26, 2021 (KR) ..... 10-2021-0067536

(51) Int. Cl.
*H01Q 15/14* (2006.01)

(52) U.S. Cl.
CPC ..... *H01Q 15/148* (2013.01)

(58) Field of Classification Search
CPC ..... H01Q 15/148; H01Q 15/0013; H01Q 15/002; H01Q 15/0026; H01L 2924/14
See application file for complete search history.

(56) References Cited

U.S. PATENT DOCUMENTS 3,596,145 A * 7/1971 Sheldon ..... H03K 17/6221 361/152
6,744,411 B1 * 6/2004 Osterhues ..... H01Q 3/34 343/754
2012/0235848 A1 * 9/2012 Bruno ..... H01Q 15/0086 342/16
2012/0256811 A1 * 10/2012 Colburn ..... H01Q 15/141 343/907
2016/0087342 A1 * 3/2016 Alu ..... H01Q 17/007 342/4

(Continued)

FOREIGN PATENT DOCUMENTS

CN 106329147 A * 1/2017
CN 111478050 A * 7/2020 ..... H01Q 15/0013

(Continued)

OTHER PUBLICATIONS

Korean Office Action dated Jun. 22, 2022, in counterpart Korean Patent Application No. 10-2021-0067536 (3 Pages in Korean).

*Primary Examiner* — Ab Salam Alkassim, Jr.
*Assistant Examiner* — Leah Rosenberg
(74) *Attorney, Agent, or Firm* — NSIP Law

(57) ABSTRACT

Provided is a reflective intelligent reflecting surface (IRS) flexible board, which includes: a flexible film; and a plurality of unit cells formed on the flexible film, in which each of the plurality of unit cells includes an IC for adjusting a reflection phase, a line pattern for driving the IC, and first and second antenna patterns formed symmetrically to each other based on the IC or the line pattern.

10 Claims, 6 Drawing Sheets

(56) References Cited

U.S. PATENT DOCUMENTS

2018/0331038 A1* 11/2018 DeLaCruz ..... H01L 27/0688

FOREIGN PATENT DOCUMENTS

| | | | | | |
|---|---|---|---|---|---|
| GB | 2507351 | A | * | 4/2014 | ..... G01S 13/756 |
| KR | 10-2007-0108858 | A | | 11/2007 | |
| KR | 10-2011-0062288 | A | | 6/2011 | |
| KR | 10-2021-0031420 | A | | 3/2021 | |
| WO | WO-2021210004 | A1 | * | 10/2021 | ..... H01Q 15/002 |
| WO | WO-2022061469 | A1 | * | 3/2022 | |

* cited by examiner

REFLECTIVE INTELLIGENT REFLECTING SURFACE FLEXIBLE BOARD

CROSS-REFERENCE TO RELATED APPLICATIONS

This application claims the priority of Korean Patent Application No. 10-2021-0067536 filed on May 26, 2021, in the Korean Intellectual Property Office, the disclosure of which is incorporated herein by reference.

BACKGROUND

Field

The present disclosure relates to a reflective intelligent reflecting surface (IRS) flexible board, and more particularly, to a reflective intelligent reflecting surface (IRS) flexible board adopting ultra-light, flexible, and low-cost printing IRS technology, which is capable of solving a technical limitation of ultra high frequency band communication using IRS.

Description of Related Art

As the main innovation of 5G cellular telecommunications, which is currently in commercialization, millimeter wave band communications such as 28 GHz may be presented, and in the future, in 6G communication, it is expected to consider the introduction of higher terahertz wave bands than the millimeter wave band communication to secure a bandwidth.

The ultra high band communication has a potential to utilize an ultra wideband spectrum beyond a microwave band, but full-scale commercialization is delayed due to problems such as high path loss, a communication shade region, etc.

In the ultra high band, a signal is received by a small effective antenna opening surface according to a very short wavelength and high path loss is generated, and as a result, the ultra high band communication is inadequate for long-range communication and transmittance to a solid is low due to very high straightness, and as a result, a place where a line of sight (LOS) is not maintained is regarded as the communication shade region.

In recent years, the industries and academia have been actively researching to overcome the ultra high band problem through introduction of the intelligent reflecting surface (IRS) technology.

In 5G mobile communications, the path loss of the ultra high band is recovered by using large-scale MIMO or hybrid beamforming, but complexity and cost significantly increase due to multiple RF chains or phase shifters.

The IRS implements each unit cell by simple control elements such as a pattern of a PCB and a PIN diode and excludes a feeding network to form a large opening surface with very low cost, thereby generating a high gain beam.

In the case of the reflective IRS, since beamforming which reflects an electromagnetic wave in a desired direction is possible by converting a phase of the electromagnetic wave incident in each unit cell, an IRS relay receives a signal with a large area to be resistant to the path loss compared with the existing relay and is constituted by a passive element to achieve an advantage of low complexity and power consumption.

However, even in the ultra high frequency band communication using the IRS, there is a clear technical dilemma, and manufacturing costs and an installation difficulty are significantly remarkable in terms of commercialization among them.

Since the existing IRS is manufactured by mounting the passive element in the PCB, the cost is even lower than the large-scale MIMO having the same number of antennas, but multiple IRSs should be installed to form a radio path, and several tens of thousands or more of unit cells should be configured, and as a result, the cost may significantly increase.

Further, since a large-area IRS may be difficult to install on a wall surface and harm the aesthetics, the large-area IRS may be difficult to apply to universal environments.

In recent years, a research capable of applying the ultra light, flexible, and low-cost printing IRS technology capable of solving the technical limitation of ultra high frequency band communication using the IRS has been conducted.

SUMMARY

An object to be achieved by the present disclosure is to provide a reflective intelligent reflecting surface (IRS) flexible board adopting an ultra light, flexible, and low-cost printing IRS technology capable of solving a technical limitation of ultra high frequency band communication using IRS.

The objects of the present disclosure are not limited to the above-mentioned objects, and other objects and advantages of the present disclosure that are not mentioned can be understood by the following description, and will be more clearly understood by exemplary embodiments of the present disclosure. Further, it will be readily appreciated that the objects and advantages of the present disclosure can be realized by means and combinations shown in the claims.

According to an aspect of the present disclosure, there is provided a reflective intelligent reflecting surface (IRS) flexible board, which may include: a flexible film; and a plurality of unit cells formed on the flexible film, in which each of the plurality of unit cells may include an IC for adjusting a reflection phase, a line pattern for driving the IC, and first and second antenna patterns formed symmetrically to each other based on the IC or the line pattern.

The line pattern and the first and second antenna patterns may be printed on the flexible film with at least one of conductive ink and functional ink.

The line pattern may include the ground line, the serial line, the clock line, and the power line on which the IC is mounted.

The first and second antenna patterns may phase-adjust a first RF signal incident according to an operation of the IC to reflect a second RF signal.

The first and second antenna patterns may have a polygonal shape.

A pinching angle between contiguous sides of each of the first and second antenna patterns may be 90° to 150°.

The line pattern may include the ground line, the serial line, the clock line, and the power line on which the IC is mounted, and the IC may include a PIN diode connected to the ground line, a D-flipflop connected to the PIN diode, the serial line, and the clock line and performing an on/off operation of the PIN diode, and an RF choke connected to the power line and preventing an RF signal from being input into DC power input into the IC through the power line.

The RF choke may be a low pass filter constituted by an LC circuit.

According to the present disclosure, a reflective intelligent reflecting surface (IRS) flexible board has an advantage of being capable of designing and implementing an IRS unit cell by inkjet printing using conductive ink and functional ink, and configuring a surface in a roller form to easily cut and expand the surface, like cutting with scissors or attaching paper.

Meanwhile, the effects of the present disclosure are not limited to the above-mentioned effects, and various effects can be included within the scope which is apparent to those skilled in the art from contents to be described below.

BRIEF DESCRIPTION OF THE DRAWINGS

The above and other aspects, features, and other advantages of the present disclosure will be more clearly understood from the following detailed description taken in conjunction with the accompanying drawings, in which.

DETAILED DESCRIPTION

Figure 1:
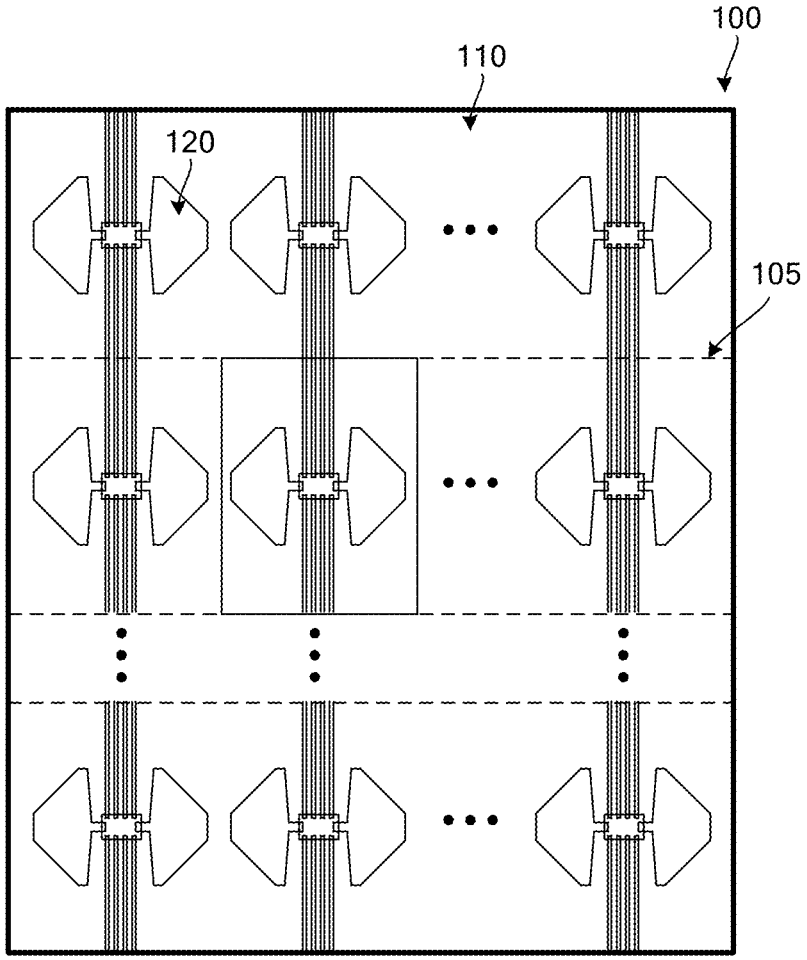
FIG. 1 is a brief perspective view illustrating a reflective intelligent reflecting surface (IRS) flexible board according to the present disclosure.

The present disclosure may have various modifications and various exemplary embodiments and specific exemplary embodiments will be illustrated in the drawings and described in detail. However, this does not limit the present disclosure to specific exemplary embodiments, and it should be understood that the present disclosure covers all the modifications, equivalents, and replacements included within the idea and technical scope of the present disclosure. In describing each drawing, like reference numerals refer to like elements.

Terms including first, second, A, B, and the like are used for describing various constituent elements, but the constituent elements are not limited by the terms. The terms are used only to discriminate one element from another element. For example, a first component may be referred to as a second component, and similarly, the second component may be referred to as the first component without departing from the scope of the present disclosure. A term and/or includes a combination of a plurality of associated disclosed items or any item of the plurality of associated disclosed items.

It should be understood that, when it is described that a component is "connected to" or "accesses" another component, the component may be directly connected to or access the other component or a third component may be present therebetween. In contrast, when it is described that a component is "directly connected to" or "directly accesses" another component, it is understood that no element is present between the element and another element.

Terms used in the present application are used only to describe specific exemplary embodiments, and are not intended to limit the present disclosure. A singular form may include a plural form if there is no clearly opposite meaning in the context. In the present application, it should be understood that a term "include" or "have" indicates that a feature, a number, a step, an operation, a component, a part, or the combination thereof described in the specification is present, but does not exclude a possibility of presence or addition of one or more other features, numbers, steps, operations, components, parts, or combinations thereof, in advance.

If it is not contrarily defined, all terms used herein including technological or scientific terms have the same meanings as those generally understood by a person with ordinary skill in the art. Terms which are defined in a generally used dictionary should be interpreted to have the same meaning as the meaning in the context of the related art, and are not interpreted as an ideal meaning or excessively formal meanings unless clearly defined in the present application.

Hereinafter, a preferred exemplary embodiment of the present disclosure will be described in detail with reference to the accompanying drawings.

Figure 2:
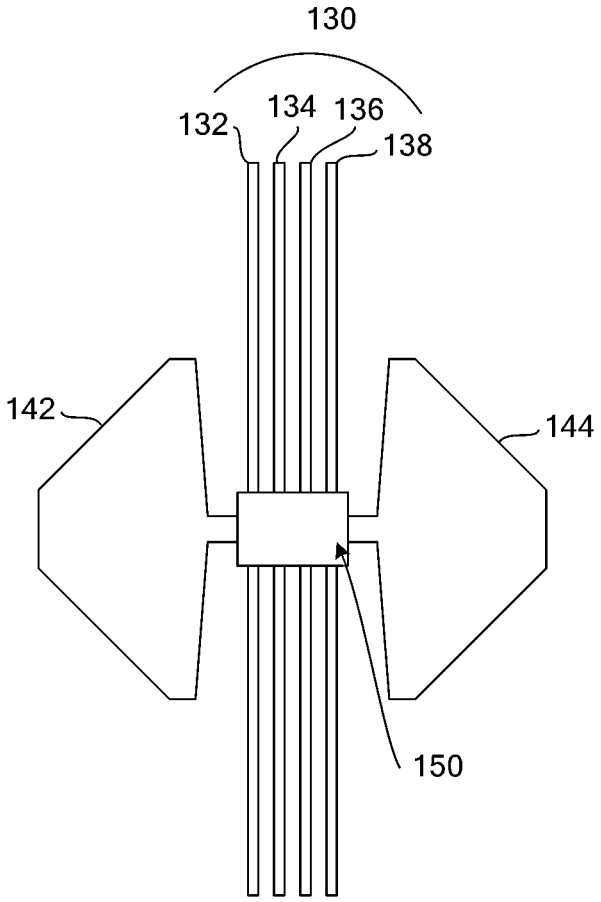
FIG. 2 is an enlarged view of enlarging an IRS unit cell illustrated in FIG. 1.
Figure 3:
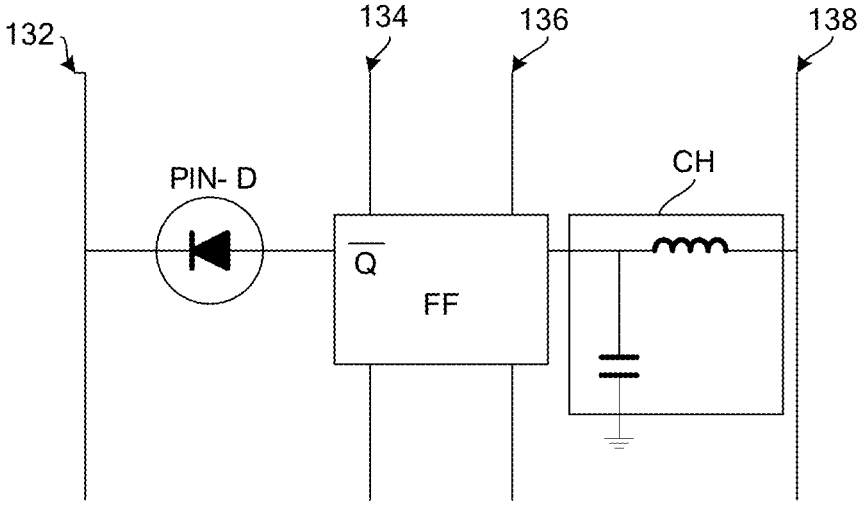
FIG. 3 is a diagram illustrating a connection structure of an IC illustrated in FIG. 2.

FIG. 1 is a brief perspective view illustrating a reflective intelligent reflecting surface (IRS) flexible board according to the present disclosure, FIG. 2 is an enlarged view of enlarging an IRS unit cell illustrated in FIG. 1, and FIG. 3 is a diagram illustrating a connection structure of an IC illustrated in FIG. 2.

Referring to FIGS. 1 to 3, the reflective IRS flexible board 100 may include a flexible film 110 and a plurality of IRS unit cells 120 (hereinafter, referred to as 'unit cell').

Here, the flexible film 110 may be a flexible transparent film having a thickness of approximately 0.1 mm.

In the exemplary embodiment, the flexible film 110 may be in a state in which at least two films overlap with each other, and is not limited thereto.

That is, the flexible film 110 may include a base film (not illustrated) in which the plurality of unit cells 120 is formed and a cover film (not illustrated) laminated on the base film to protect the plurality of unit cells 120, and is not limited thereto.

A cutting line 105 may be displayed on the flexible film 110, and the plurality of unit cells 120 may be cut and used on the flexible film 110 to meet a use purpose.

Each of the plurality of unit cells 120 may include a line pattern 130, first and second antenna patterns 142 and 144, and an IC 150.

In the exemplary embodiment, it is described that the IC 150 is mounted on each of the plurality of unit cells 120, but the present disclosure is not limited thereto.

First, the line pattern 130 may include a ground line 132, a serial line 134, a clock line 136, and a power line 138.

In this case, the ground line 132, the serial line 134, the clock line 136, and the power line 138 may be formed with a thickness of 0.1 mm, and an interval between respective lines among the ground line 132, the serial line 134, the clock line 136, and the power line 138 may be 0.2 mm.

The line pattern 130, and the first and second antenna patterns 142 and 144 may be printed on the flexible film 110 with at least one of conductive ink and functional ink.

The first and second antenna patterns 142 and 144 phase-adjust a first RF signal incident according to an operation of the IC 150 to reflect a second RF signal.

Here, the first and second antenna patterns 142 and 144 may have a polygonal shape, and a pinching angle between contiguous sides of each of the first and second antenna patterns 142 and 144 may be 90° to 150°, but the present disclosure is not limited thereto.

The first and second antenna patterns 142 and 144 may be formed symmetrically to each other based on the line pattern 130 or the IC 150.

Here, the first and second antenna patterns 142 and 144 may resonate at a desired frequency based on resonance properties, and reduce cost.

The IC 150 may include a PIN diode (PIN-D), a D-flipflop (FF), and an RF choke (CH).

The PIN diode (PIN-D) may be connected to the ground line 132.

The D-flipflop (FF) may be connected to the PIN diode (PIN-D), the serial line 134, and the clock line 136, and may perform an on/off operation of the PIN diode (PIN-D).

That is, the D-flipflop (FF) connects the clock line 136 to the inside to use the clock line 136 as C and a clock signal of a data signal output from the serial line 134.

Here, the data signal may be output to the PIN diode (PIN-D), and may form a closed loop with a negative electrode of the PIN diode (PIN-D) and the ground of the IC 150.

The D-flipflop may be constituted by one D-flipflop serving as a memory device and a delivery device, and may receive and store a control signal through a serial terminal 132, and stored data may be output from $\overline{Q}$ whenever the clock signal becomes 1.

The RF choke (CH) may minimize interference between an incident RF signal and DC power which flows on the power line 138.

That is, the RF choke (CH) may be connected to the power line 138, and may prevent the RF signal from being input into the DC power input into the IC 150 through the power line 138.

Here, the RF choke (CH) may be a low pass filter constituted by an LC circuit, and is not limited thereto.

Figure 4:
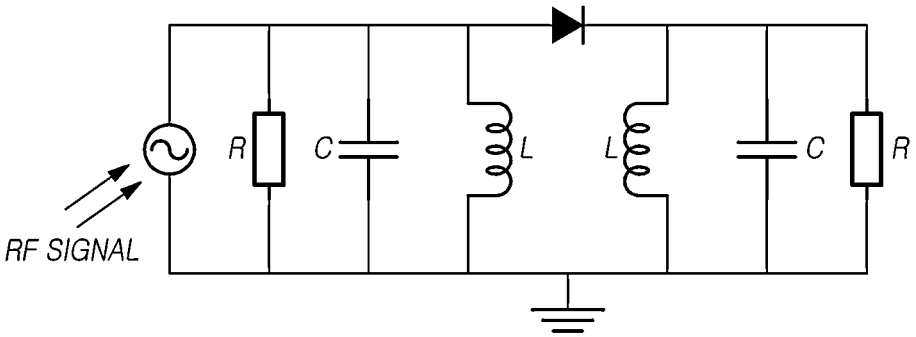
FIG. 4 is an equivalent circuit diagram of the IRS unit cell illustrated in FIG. 2.
Figure 5A:
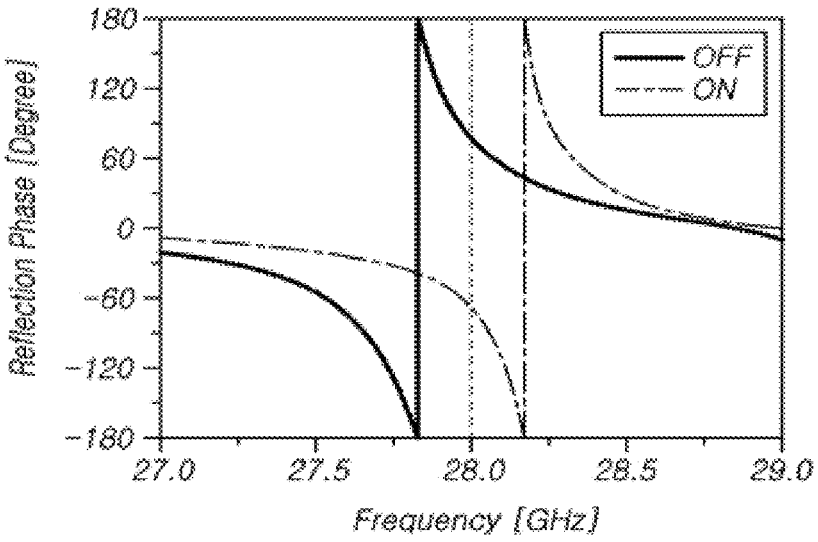
FIGS. 5A-5B are diagrams illustrating a simulation result for the IRS unit cell illustrated in FIG. 2.
Figure 5B:
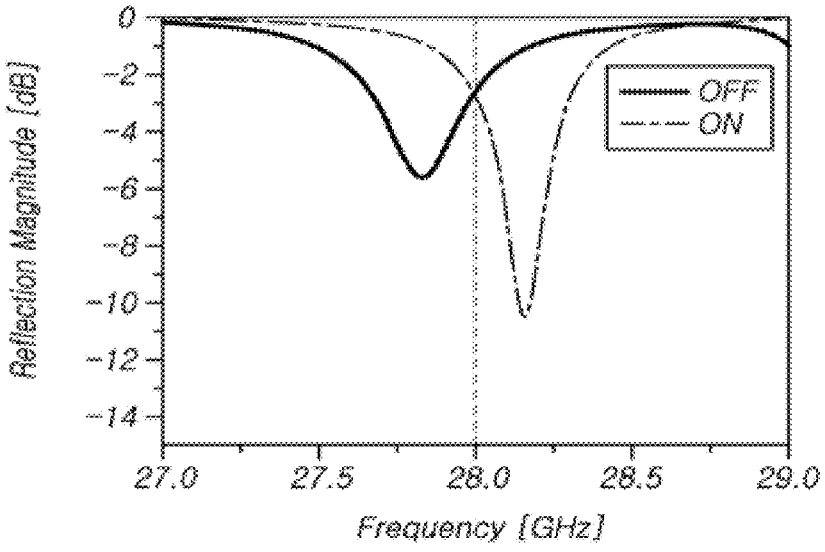
Figure 6:
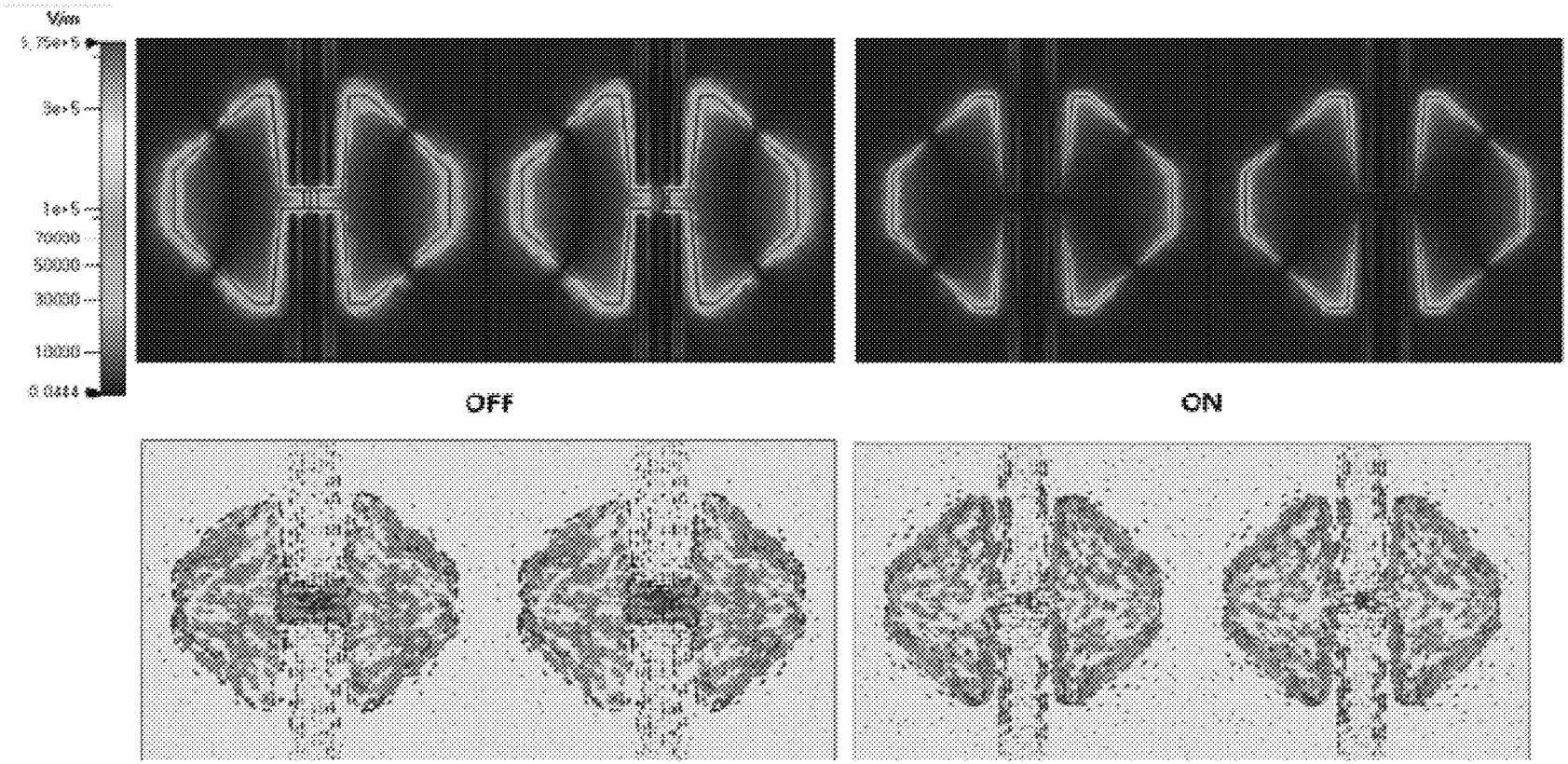
FIG. 6 is a diagram illustrating a electric field distribution of the IRS unit cell illustrated in FIG. 2.

FIG. 4 is an equivalent circuit diagram of the IRS unit cell illustrated in FIG. 2, FIG. 5 is a diagram illustrating a simulation result for the IRS unit cell illustrated in FIG. 2, and FIG. 6 is a diagram illustrating a electric field distribution of the IRS unit cell illustrated in FIG. 2.

FIG. 4, as an equivalent circuit diagram of the unit cell 120, illustrates an equivalent circuit for the line pattern 130, the first and second antenna patterns 140, and the IC 150.

FIGS. 5A-5B illustrate a simulation result for the unit cell 120.

FIG. 5A is a diagram illustrating a phase response in the on/off operation of the unit cell 120 and FIG. 5B is a diagram illustrating a size response in the on/off operation of the unit cell 120.

In FIGS. 5A and 5B, the unit cell operates like an R-L-C resonance circuit, a reflection phase is changed from −180° to 180° at a resonance point, and when the PIN diode (PIN-D) is turned on or off, it is possible to shift the reflection phase by changing a resonant frequency of a patch, and a simulation for a reflection phase and a reflection size between ON and OFF states of the PIN diode (PIN-D) is illustrated.

FIG. 6, as a diagram illustrating the electric field distribution of the unit cell, illustrates a electric field distribution generated in the first and second antenna patterns 142 and 144 in the on/off operation of the PIN diode (PIN-D).

As can be seen in FIGS. 4 to 6, an OFF state reflection phase of the unit cell 120 in which the PIN diode (PIN-D) is positioned is ahead of that in the ON state at a target frequency by 180 degrees.

The reflection size may be confirmed as approximately −3 dB, and loss may occur by a structure of a unit cell 120 storing resistance or energy of the PIN diode (PIN-D).

Features, structures, effects, and the like described in the above exemplary embodiments are included in at least one exemplary embodiment of the present disclosure, and are not particularly limited to only one exemplary embodiment. Furthermore, features, structures, effects, and the like exemplified in each exemplary embodiment may be combined or modified for other exemplary embodiments those skilled in the art to which the exemplary embodiments pertain. Therefore, the contents related to such combinations and modifications should be interpreted as being included in the scope of the present disclosure.

In addition, although the exemplary embodiments have been mainly described above, these are merely examples and do not limit the present disclosure, and those skilled in the art to which the present disclosure pertains will know that various modifications and applications not illustrated above can be made within the scope without departing from the essential characteristics of the exemplary embodiment. For example, each component specifically shown in the exemplary embodiment may be implemented by being modified. In addition, it will be interpreted that differences related to the modifications and applications are included in the scope of the present disclosure defined in the appended claims.

What is claimed is:

1. A reflective intelligent reflecting surface (IRS) flexible board, comprising:
- a flexible film; and
- a plurality of unit cells formed on the flexible film,
- wherein each of the plurality of unit cells includes:
  - an IC configured to adjust a reflection phase,
  - a line pattern for driving the IC, and
  - first and second antenna patterns formed symmetrically with each other based on the IC or the line pattern,
- wherein the line pattern comprising a ground line, a serial line, a clock line, and a power line is arranged between the first and second antenna patterns, and is disposed below the IC comprising an RF choke configured to prevent an RF signal from entering a DC power input to the IC through the power line.

2. The reflective IRS flexible board of claim 1, wherein the line pattern, and the first and second antenna patterns are printed on the flexible film using at least one of conductive ink and functional ink.

3. The reflective IRS flexible board of claim 1, wherein the IC further comprises:
- a positive-intrinsic-negative (PIN) diode connected to the ground line; and
- a D-flipflop connected to the PIN diode, the serial line and the clock line, and performing an on/off operation of the PIN diode.

4. The reflective IRS flexible board of claim 1, wherein the first and second antenna patterns are configured to adjust a phase of an incident first RF signal according to an operation of the IC to reflect a second RF signal.

5. The reflective IRS flexible board of claim 1, wherein the first and second antenna patterns have a polygonal shape.

6. A reflective intelligent reflecting surface (IRS) flexible board, comprising:
- a flexible film; and
- a plurality of unit cells formed on the flexible film,
- wherein each unit cell comprises:
- an IC configured to adjust a reflection phase,
- a line pattern for driving the IC, and
- first and second antenna patterns formed symmetrically with each other based on the IC or the line pattern,
- wherein the line pattern includes a ground line, a serial line, a clock line, and a power line on which the IC is mounted, and
- wherein the IC includes:

a positive-intrinsic-negative (PIN) diode connected to the ground line;

a D-flipflop connected to the PIN diode, the serial line, and the clock line, and performing an on/off operation of the PIN diode; and an RF choke connected to the power line, and configured to prevent an RF signal from entering a DC power input to the IC through the power line.

7. The reflective IRS flexible board of claim 6, wherein the RF choke is a low pass filter constituted by an LC circuit.

8. The reflective IRS flexible board of claim 6, wherein the line pattern, and the first and second antenna patterns are printed on the flexible film using at least one of conductive ink and functional ink.

9. The reflective IRS flexible board of claim 6, wherein the first and second antenna patterns are configured to adjust a phase of an incident first RF signal according to an operation of the IC to reflect a second RF signal.

10. The reflective IRS flexible board of claim 6, wherein the first and second antenna patterns have a polygonal shape.

* * * * *